US007575540B1

(12) United States Patent
Dobrow et al.

(10) Patent No.: US 7,575,540 B1
(45) Date of Patent: Aug. 18, 2009

(54) EXERCISE BALL RISER

(76) Inventors: Lisa Dobrow, 7603 Old Thyme Ct., Unit 4C, Parkland, FL (US) 33076; Steve Dobrow, 7603 Old Thyme Ct., Unit 4C, Parkland, FL (US) 33076

( * ) Notice: Subject to any disclaimer, the term of this patent is extended or adjusted under 35 U.S.C. 154(b) by 0 days.

(21) Appl. No.: 12/360,377

(22) Filed: Jan. 27, 2009

Related U.S. Application Data

(63) Continuation of application No. 12/262,716, filed on Oct. 31, 2008, now abandoned.

(60) Provisional application No. 61/067,136, filed on Feb. 26, 2008.

(51) Int. Cl.
*A63B 26/00* (2006.01)

(52) U.S. Cl. ..... 482/142; 482/140

(58) Field of Classification Search ..... 482/140, 482/142, 23, 79, 91, 121–123, 129–130, 482/907; 446/220; D21/662, 696, 686
See application file for complete search history.

(56) References Cited

U.S. PATENT DOCUMENTS

| | | | | | |
|---|---|---|---|---|---|
| 5,154,678 | A | * | 10/1992 | Adamczyk et al. | 482/52 |
| 5,176,596 | A | * | 1/1993 | Ullman | 482/52 |
| 5,269,735 | A | * | 12/1993 | Pfitzenmeier | 482/52 |
| 5,290,210 | A | * | 3/1994 | Hand et al. | 482/51 |
| 5,318,489 | A | * | 6/1994 | Irwin | 482/52 |
| 5,354,247 | A | * | 10/1994 | Wilkinson | 482/52 |
| 5,441,466 | A | * | 8/1995 | Piaget et al. | 482/52 |
| 5,591,105 | A | * | 1/1997 | Dalebout et al. | 482/52 |
| 5,620,404 | A | * | 4/1997 | Eyman | 482/142 |
| 5,672,144 | A | * | 9/1997 | Hulme | 482/140 |
| 5,833,587 | A | * | 11/1998 | Strong et al. | 482/123 |
| 6,422,983 | B1 | * | 7/2002 | Weck | 482/147 |
| 6,461,284 | B1 | * | 10/2002 | Francavilla | 482/142 |
| 6,554,753 | B1 | * | 4/2003 | Weck et al. | 482/147 |
| 6,575,885 | B1 | * | 6/2003 | Weck et al. | 482/147 |
| D476,705 | S | * | 7/2003 | Dillard | D21/662 |
| 6,669,611 | B2 | * | 12/2003 | Raymond | 482/148 |
| 6,702,726 | B2 | * | 3/2004 | Lin | 482/148 |
| 6,719,676 | B1 | * | 4/2004 | Hsu | 482/121 |
| 6,740,008 | B1 | * | 5/2004 | Ho et al. | 482/34 |
| 6,746,372 | B2 | * | 6/2004 | Hsu | 482/34 |
| D507,311 | S | * | 7/2005 | Butler et al. | D21/686 |
| 6,945,919 | B2 | * | 9/2005 | Yang | 482/142 |
| 7,004,886 | B2 | * | 2/2006 | Chen | 482/14 |
| D521,084 | S | * | 5/2006 | Huang | D21/662 |
| 7,044,558 | B2 | * | 5/2006 | Chiu | 297/452.41 |
| 7,131,934 | B2 | * | 11/2006 | Dadbeh | 482/52 |
| D560,260 | S | * | 1/2008 | Flentye et al. | D21/694 |
| 2005/0101444 | A1 | * | 5/2005 | Dadbeh | 482/52 |
| 2008/0176727 | A1 | * | 7/2008 | Heitzman | 482/142 |
| 2008/0220944 | A1 | * | 9/2008 | Pratson et al. | 482/52 |

* cited by examiner

*Primary Examiner*—Lori Amerson
(74) *Attorney, Agent, or Firm*—Laurence A. Greenberg; Werner H. Stemer; Ralph E. Locher

(57) ABSTRACT

A riser in combination with a semispherical ball having a rigid base plate of a given diameter, the riser elevates the ball. The riser includes a portion extending in a longitudinal direction of the riser. The portion has an outside diameter and an inside diameter dimensioned for receiving the given diameter of the rigid base plate. A further portion is adjacent the portion and extends in the longitudinal direction of the riser. The further portion has a further inside diameter. The further inside diameter is smaller than the inside diameter thereby defining a shoulder therebetween. The shoulder is configured for supporting the base plate.

7 Claims, 7 Drawing Sheets

EXERCISE BALL RISER

CROSS-REFERENCE TO RELATED APPLICATION

This application claims the benefit of U.S. Provisional Application Ser. No. 61/067,136, filed on Feb. 26, 2008, entitled Exercise and Training Apparatus, the prior application is herewith incorporated by reference in its entirety.

BACKGROUND OF THE INVENTION

Field of the Invention

The present invention pertains to a riser or spacer that increases the height of an exercise and training apparatus. More specifically, to a riser that permits an increase in height of a semispherical inflatable ball with a rigid baseplate or platform.

Semispherical inflatable balls are used to provide an increased range of motion during exercise and physical therapy. For example, U.S. Pat. No. 6,575,885 discloses an inflatable semispherical or flat surface that may be used for physical therapy, conditioning or training. One such inflatable device is sold by Bosu Fitness LLC located in San Diego Calif. under the trademark BOSU® balance trainer. However, since the device is only about 10 inches high, it is functional for exercise and physical therapy at that height. The low height fails to accommodate potential users that are elderly, disabled, or generally less physically fit, for whom mounting and dismounting such a low lying device may be difficult or impossible. The low height also limits the difficulty of plyometric type exercises that may be done using the ball.

Aerobic steps and risers also are known for exercise and physical therapy. The steps may be stacked on the risers to create devices of varying heights. U.S. Pat. No. 5,318,489, for example, discloses the use of detachably stackable riser blocks to elevate rectangular or square platforms for use during aerobic exercise. This device, however, is a riser for elevating rectangular or square platforms.

SUMMARY OF THE INVENTION

It is accordingly an object of the invention to provide a riser for a semispherical inflatable ball, which overcomes the above-mentioned disadvantages of the heretofore-known devices of this general type and which provides a riser that is versatile, elevates the semispherical ball in a stable manner, is easy to use, and easy to store.

With the foregoing and other objects in view there is provided, a riser in combination with a semispherical ball having a rigid base plate of a given diameter, the riser elevates the ball. The riser includes a portion extending in a longitudinal direction of the riser. The portion has an outside diameter and an inside diameter dimensioned for receiving the given diameter of the rigid base plate. A further portion is adjacent the portion and extends in the longitudinal direction of the riser. The further portion has a further inside diameter. The further inside diameter is smaller than the inside diameter thereby defining a shoulder therebetween. The shoulder is configured for supporting the base plate.

In accordance with another feature of the invention, the riser includes another portion adjacent the further portion and which extends in the longitudinal direction of the riser. The other portion has another outside diameter that is larger than the outside diameter for defining a collar about a circumference of the riser. The other portion has a base surface, and the other portion has another inside diameter that is greater than the further inside diameter to define an undercut of the shoulder.

In accordance with an added feature of the invention, the riser includes plurality of longitudinally extending ribs formed on the other inside diameter and abutting the undercut.

In accordance with an additional feature of the invention, the portion has a plurality of longitudinally extending grooves formed therein at the outside diameter. Each of the grooves for accommodating a respective one of the ribs therein.

In accordance with yet an additional feature of the invention, the ribs are tapered in the longitudinal direction from the undercut to the other inside diameter In accordance with yet another added feature of the invention, the base surface is spaced from the undercut so that the base surface rests on the collar when one of the risers is stacked on another one of the risers.

In accordance with still another added feature of the invention, the base surface has a textured surface finish.

In accordance with yet still another added feature of the invention, the portion has radially distributed cutouts formed therein configured to correspond to projections of the rigid base plate.

With the objects of the invention in view, there is also provided a riser in combination with a semispherical ball having a rigid base plate of a given diameter. The riser for elevating the ball. The riser includes a cylindrical portion extending in a longitudinal direction of the riser. The portion has a support surface configured to engage and support the rigid base plate. A further cylindrical portion is adjacent the cylindrical portion and extends in the longitudinal direction of the riser. The further cylindrical portion is constructed to securely engage the support surface when one of the risers is stacked on another one of the riser.

In accordance with still a further feature of the invention, the cylindrical portion has an outside diameter and the further cylindrical portion has an inside diameter. The diameters are dimensioned so that the outside diameter can be inserted into the inside diameter.

In accordance with still another feature of the invention, the inside diameter defines a shoulder of the further cylindrical portion. The support surface engages the shoulder when one of the risers is stacked on another one of the risers.

In accordance with yet an additional feature of the invention, the support surface is a ring.

In accordance with yet an added feature of the invention, the support surface is configured to engage a structural element formed on the rigid plate.

In accordance with yet a further feature of the invention, the further cylindrical portion has a base surface with a textured surface finish.

Other features which are considered as characteristic for the invention are set forth in the appended claims.

Although the invention is illustrated and described herein as embodied as a riser for elevating a semispherical ball, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
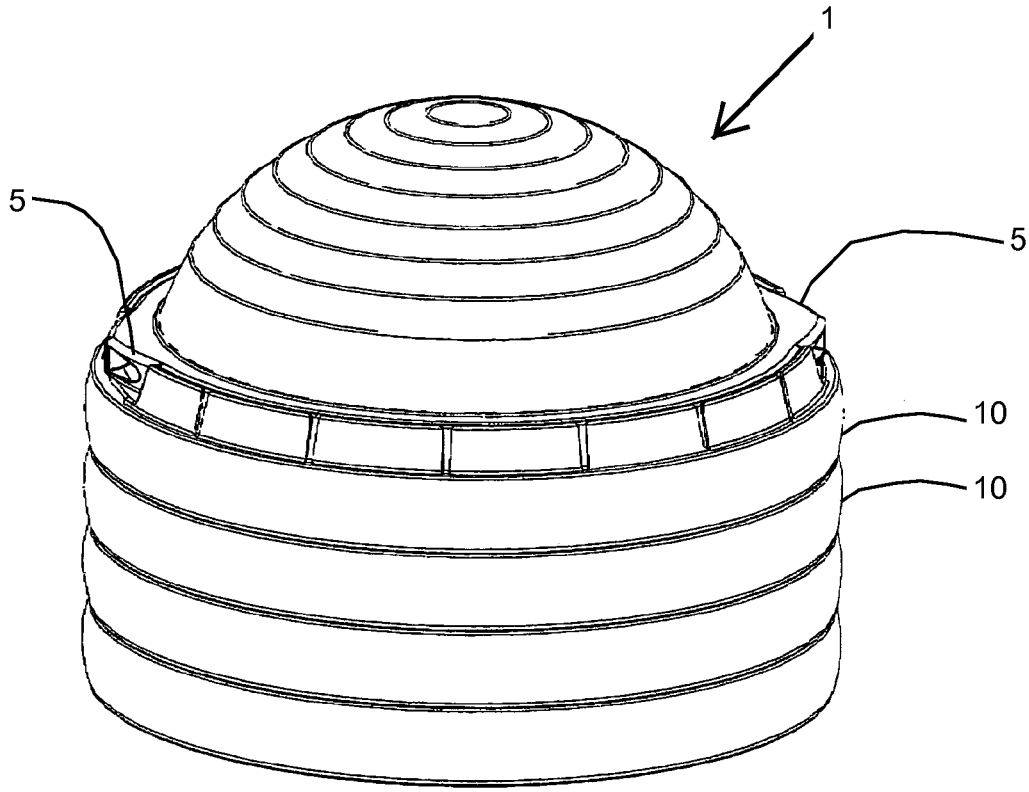
FIG. 1 is a perspective view of a semispherical ball disposed on a plurality of the risers according to the invention.
Figure 2:
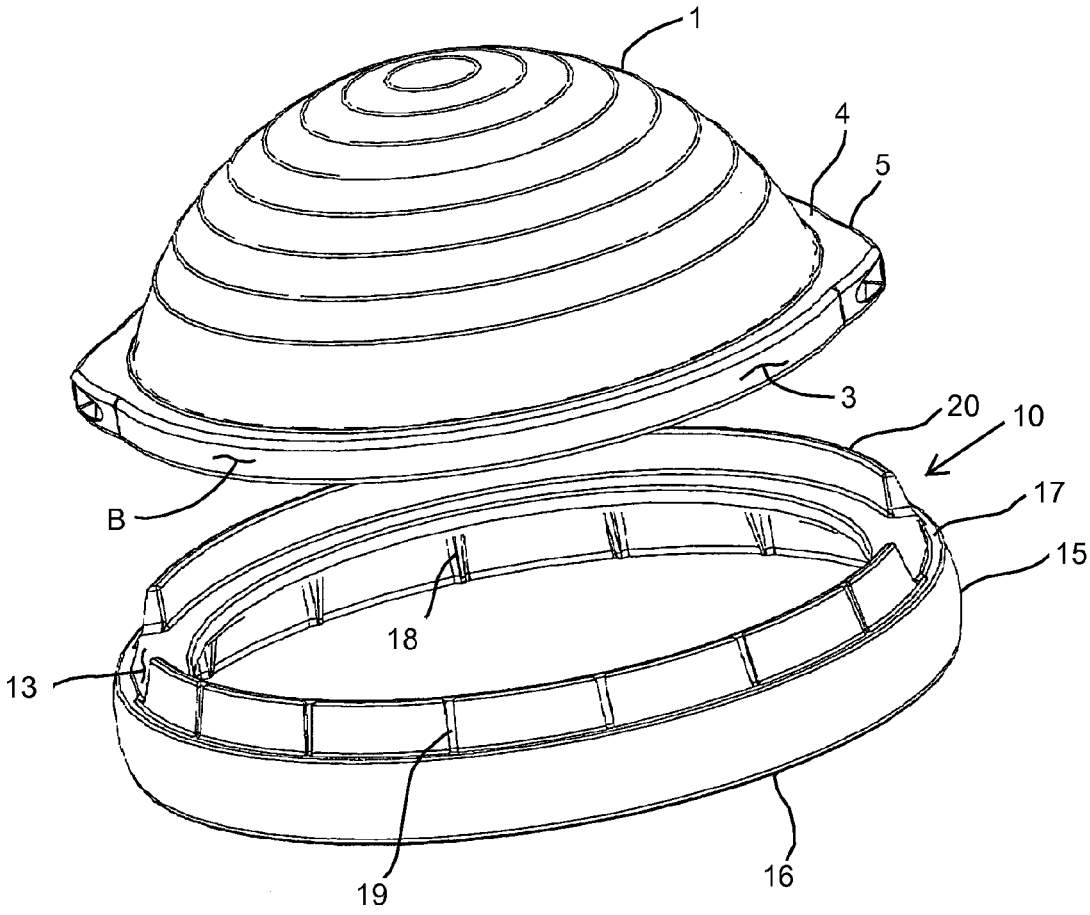
FIG. 2 is a perspective view of a semispherical ball spaced apart from the riser according to the invention.
Figure 3:
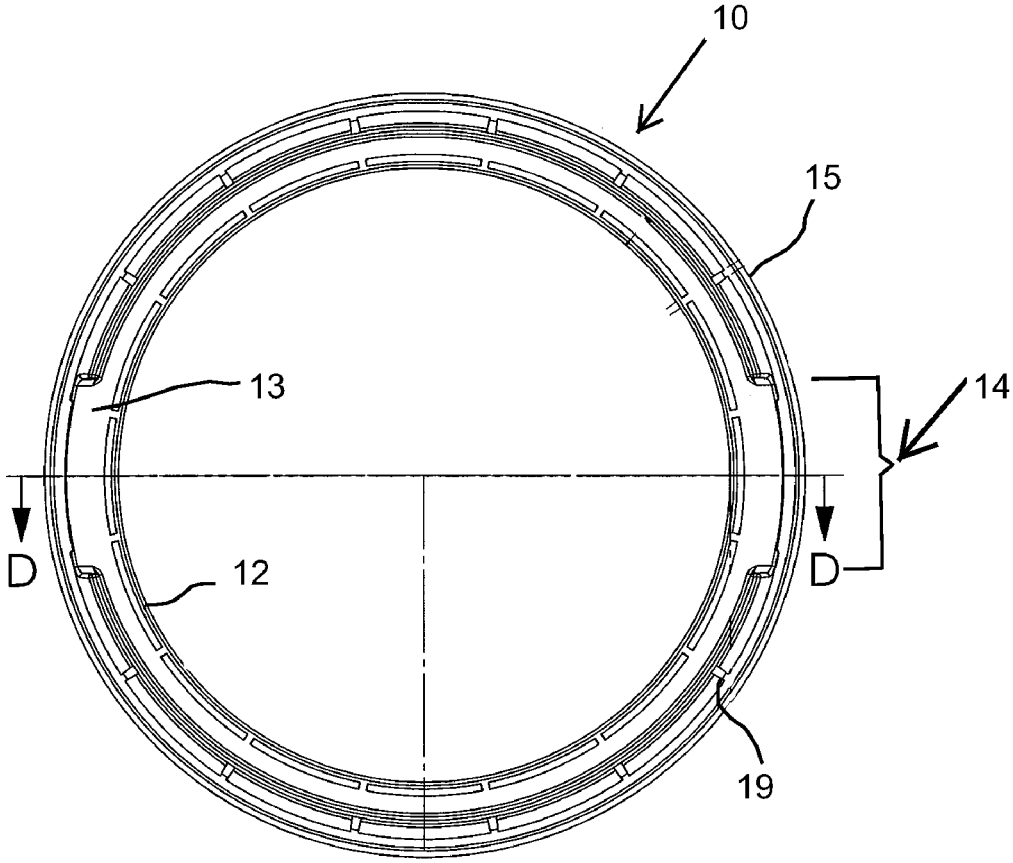
FIG. 3 is a top plan view of the of the riser according to the invention.
Figure 4:
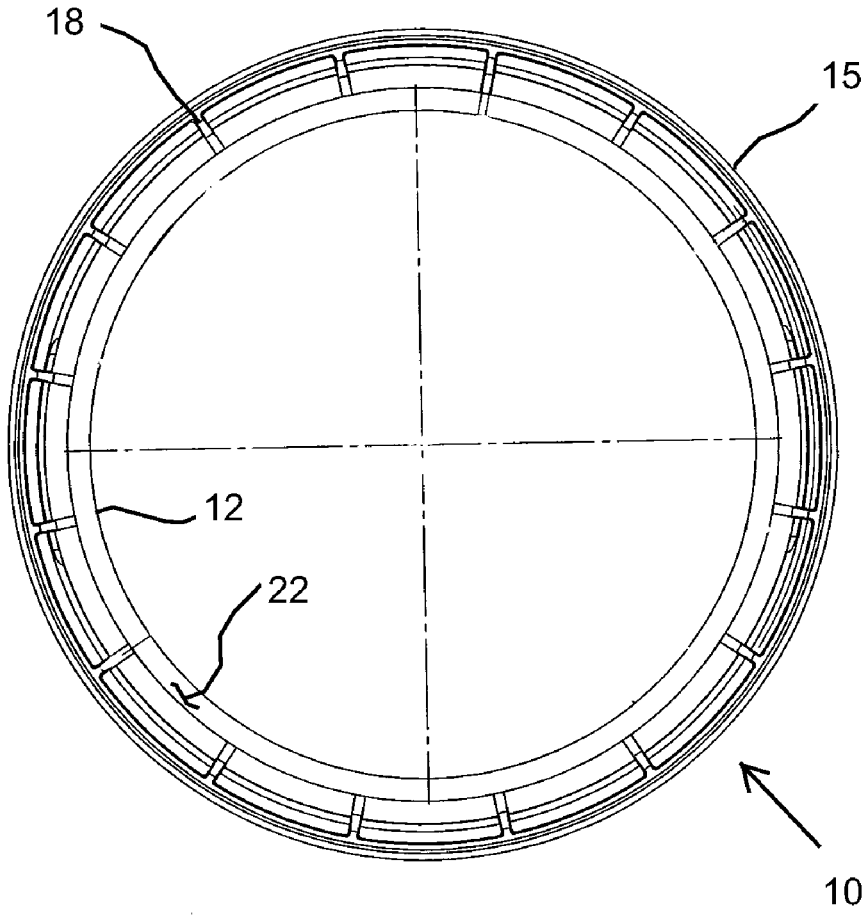
FIG. 4 is a bottom plan view of the of the riser according to the invention.
Figure 5:
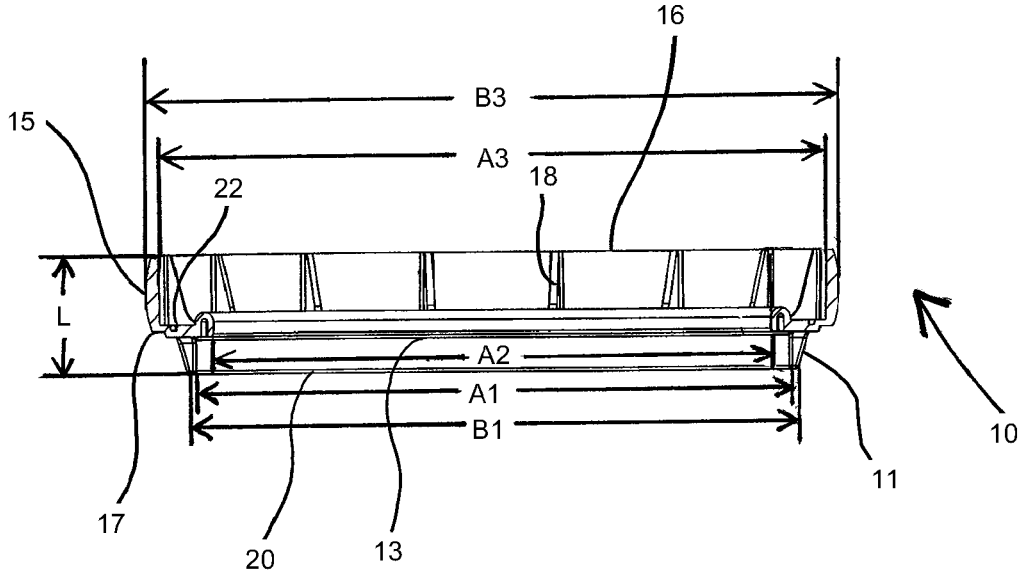
FIG. 5 is a cross-sectional view of the of the riser along section line D-D of FIG. 3, according to the invention.

Referring now to FIGS. 1 and 2 of the instant application, a semispherical inflatable ball 1 is used together with present invention. The ball 1 may be of the type such as BOSU® balance trainer. The semispherical inflatable ball 1 includes an inflatable bladder attached to a rigid plate or platform 3 having a diameter B, which is affixed to a planar side of the ball 1. The diameter B defining a cylindrical wall. The rigid plate or platform 3 is planar and has a flange 4 extending beyond the outer circumference of the planar surface of the semispherical ball 1. The flange 4 can include projections 5 on the outer circumference of the rigid plate 3. The projections 5 are disposed at or about 180° degrees apart, or in other words, opposite one another. The planar surface of the plate 3 or the flange 4 may include structural features (not shown in the drawings) such as cutouts which act as hand holds, grooves, or protrusions. Normally, the ball 1 is used by standing on or pushing against the semispherical surface of the ball 1, but also may be used by pushing against the rigid plate 3. The ball 1 typically may be up to approximately 26" in diameter and up to approximately 10" in height.

Figure 6:
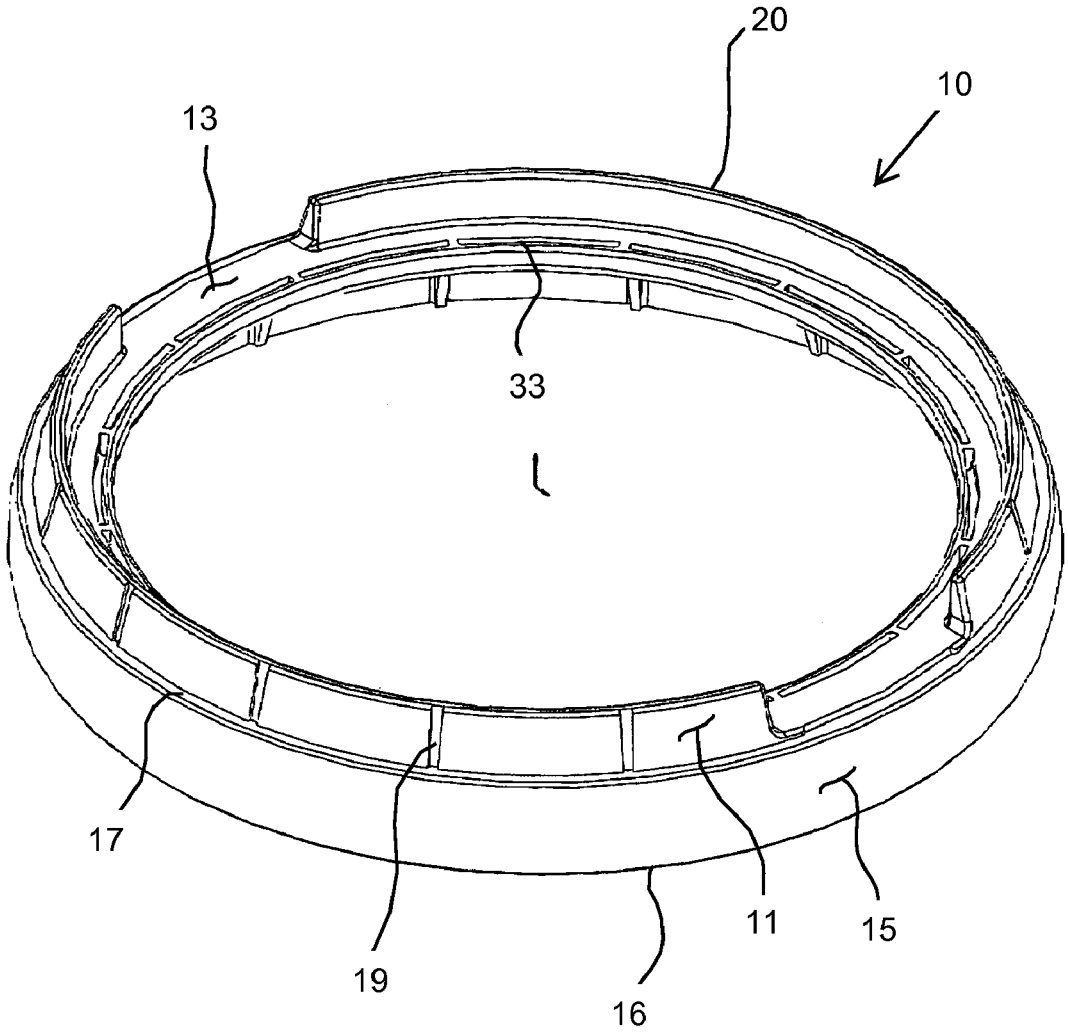
FIG. 6 is a perspective view of the riser according to the invention.
Figure 7:
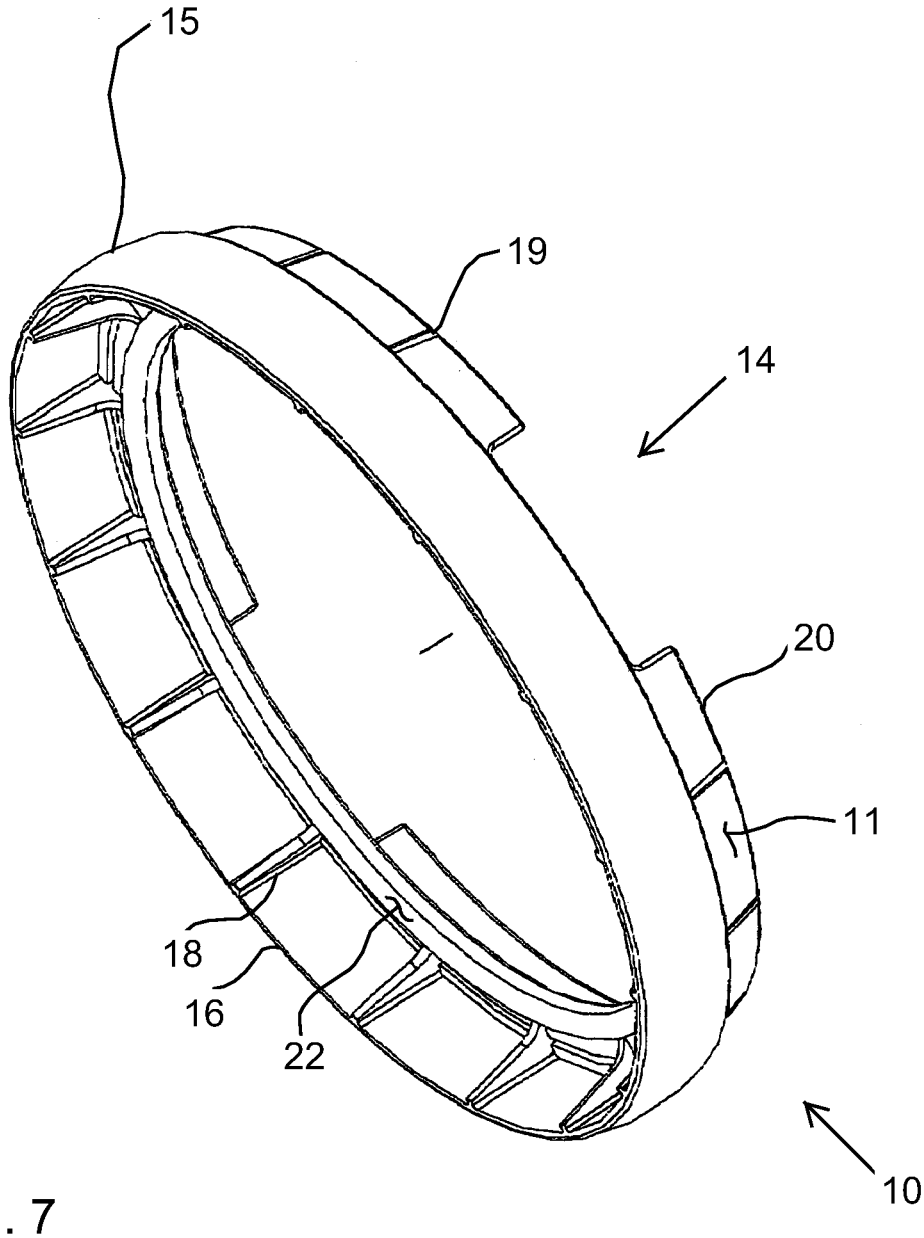
FIG. 7 is another perspective view of the riser according to the invention.

As seen in FIGS. 3-7 the present invention includes a riser 10. The riser 10 may be annular and may be provided as a cylinder. The riser 10 is used in connection with the ball 1 and elevates the ball 1. The riser 10 has a length L. The riser ring 10 has a first portion or extent 11, extending in a longitudinal direction of the riser 10, with an inside diameter A1 defining an inner wall, an outside diameter B1 defining an outer wall, and an end face 20. The riser ring 10 has a second portion or extent 12 adjacent the first portion and extending in the longitudinal direction of the riser 10. The second portion has an inside diameter A2 defining an inner wall. The inside diameter A2 of the second portion is smaller than the inside diameter A1 of the first portion, such that the inside diameter A2 defines a shoulder 13 about the circumference of the inside of the riser 10. The inside diameter A1 of the first portion is dimensioned to correspond to the diameter B of the rigid plate 3 such that the rigid plate 3 can be inserted into the riser 10 so that the planar surface of rigid plate 3 securely engages and rests upon the shoulder 13 of the riser 10 such that the shoulder 13 defines a support surface. Additionally, as seen in FIG. 6 structures 33 may be formed on the shoulder 13. The structures 33 being either grooves or elevations constructed to engage the corresponding structure on the base plate 3. The first portion 11 also has two cutouts 14 formed therein to accommodate the projections 5 on flange of the rigid plate 3 of the ball 1. Accordingly, the cutouts 14 are spaced apart to correspond to the respective projections 5. The edge of the cutouts 14 may engage the projections 5 to limit a rotation of the semispherical ball 1 within the riser 10.

The riser ring 10 has a third portion or extent 15 adjacent the second portion 12 and extending in the longitudinal direction of the riser 10. The third portion 15 has an inside diameter A3 defining an inner wall, an outside diameter B3 defining an outer wall, and a base surface 16. The base surface 16 may have a roughened or textured surface finish to prevent slippage on a support surface. Alternatively, a coating may be applied to the base surface 16 for the same purpose. The outside diameter B3 of the third portion 15 is larger than the outside diameter B1 of the first portion such that a collar 17 is defined about the circumference of the riser 10. The collar 17 may be at about the same longitudinal position of the riser 10 as the shoulder 13 on the inside of the cylinder.

The inside diameter A3 of the third portion 15 is larger than the inside diameter A2 of the second portion 12 and defines an undercut 22 of the shoulder 13 and has a plurality of longitudinally extending ribs 18 formed thereon which are radially distributed about the inside diameter A3 of the third portion 15. The longitudinally extending ribs 18 abut the undercut 22 of the shoulder 13 to rigidly support the shoulder 13 and increase the rigidity of the shoulder 13, which supports the ball 1. The longitudinally extending ribs 18 can be tapered down towards the inside diameter A3 of the third portion 15 in the longitudinal direction of the riser 10.

The outside diameter B1 of the first portion 11 is dimensioned to correspond to the inside diameter A3 of the third portion 15 such that the first portion 11 of a riser 10 can slide into the third portion 15 of another riser 10. Furthermore, the outside diameter B1 of the first portion has a plurality of longitudinally extending grooves 19 formed therein, the grooves 19 are radially distributed about the outside diameter A3 of the first portion 11 and correspond to respective ribs 18 such that the ribs 18 engage the grooves 19 when risers 10 are stacked upon one another. The engagement of the ribs 18 in the grooves 19 serves to radially align the risers 10 with respect to one another and serves as an anti-rotation mechanism to prevent a rotation between the risers 10, when risers 10 are stacked upon one another.

The risers 10 are dimensioned such that when a first riser 10 is placed upon a second riser 10 so that the base surface 16 of the first riser 10 engages the collar 17 of the second riser 10 and supports the first riser 10. Additionally, the riser may be dimensioned such that the end face 20 of the second riser 10 engages the undercut 22 of the shoulder 13 of the first riser 10 to further support the first riser 10.

It is preferred that the riser 10 be made of a plastic material by a process of injection molding, blow molding or other similar process. It is also possible for the base surface 16 to be overmolded with a thermoplastic elastomer to increase the grip on the support surface such as the floor or ground.

The invention claimed is:

1. The exercise ball riser for elevation in combination with a semispherical ball having a rigid base plate of a predetermined diameter, the riser for elevating the ball comprising:

a first portion extending in a longitudinal direction of the riser, said first portion having an outside diameter and an inside diameter dimensioned for receiving the predetermined diameter of the rigid base plate;

a second portion adjacent said first portion and extending in the longitudinal direction of the riser, said second portion having an inside diameter, said inside diameter of said second portion being smaller than said inside diameter of said first portion thereby defining a shoulder therebetween, said shoulder being configured for supporting the base plate;

a third portion adjacent said second portion and extending in the longitudinal direction of the riser, said third portion having outside diameter being larger than said outside diameter of said first portion for defining a collar about a circumference of the riser, said third portion having a base surface, and said third portion having an inside diameter being greater than said inside diameter of said second portion for defining an undercut of said shoulder.

2. The riser according to claim 1, further comprising a plurality of longitudinally extending ribs formed on said inside diameter of said third portion and abutting said undercut.

3. The riser according to claim 2, wherein said first portion has a plurality of longitudinally extending grooves formed therein at said outside diameter of said first portion, each of said grooves for accommodating a respective one of said ribs therein.

4. The riser according to claim 3, wherein said ribs are tapered in the longitudinal direction from said undercut to said inside diameter of said third portion.

5. The riser according to claim 3, wherein said base surface is spaced from said undercut so that said base surface rests on said collar when one of the risers is stacked on another one of the risers.

6. The riser according to claim 3, wherein said base surface has a textured surface finish.

7. The riser according to claim 4, wherein said first portion has radially distributed cutouts formed therein configured to correspond to projections of the rigid base plate.

* * * * *